United States Patent [19]

Robbins

[11] Patent Number: 4,824,139

[45] Date of Patent: Apr. 25, 1989

[54] SKATEBOARD WITH AUDIO ENTERTAINMENT DEVICE

[75] Inventor: William D. Robbins, Succasunna, N.J.

[73] Assignee: nash Manufacturing Co., Fort Worth, Tex.

[21] Appl. No.: 147,140

[22] Filed: Jan. 22, 1988

[51] Int. Cl.[4] ..... A63C 17/02; A63C 17/14

[52] U.S. Cl. ..... 280/816; 280/87.042; 455/344; 455/346

[58] Field of Search ..... 280/11.1 R, 11.19, 87.04 A, 280/87.04 R, 87.04 B, 289 R, 809, 811, 816; 455/344, 345, 346, 350, 351

[56] References Cited

U.S. PATENT DOCUMENTS

| | | | |
|---|---|---|---|
| 3,157,871 | 11/1964 | Umanoff | 455/345 X |
| 3,500,210 | 3/1970 | Tashian | 455/344 X |
| 4,165,090 | 8/1979 | Feddersohn et al. | 280/87.04 A |
| 4,270,764 | 6/1981 | Yamada | 280/87.04 A |
| 4,279,342 | 7/1981 | Van Pelt | 455/351 X |
| 4,362,907 | 12/1982 | Polacsek | 455/345 |
| 4,460,187 | 7/1984 | Shimizu | 280/87.04 A X |
| 4,463,412 | 7/1984 | Broach | 280/816 X |

FOREIGN PATENT DOCUMENTS

| | | | |
|---|---|---|---|
| 526464 | 2/1954 | Belgium | 455/345 |

OTHER PUBLICATIONS

Washington Post Comic, Parade Magazine Insert, Oct. 26, 1986, p. 20.

*Primary Examiner*—David M. Mitchell
*Assistant Examiner*—Brian L. Johnson
*Attorney, Agent, or Firm*—Andrew J. Dillon

[57] ABSTRACT

A skateboard having an associated audio entertainment device is disclosed. The skateboard includes a forward truck and wheel assembly and a rearward truck and wheel assembly. A tail skid plate is preferably mounted at the rear of the skateboard on the lower surface thereof. An audio entertainment device, such as a radio receiver, is mounted to the lower surface of the skateboard between the rearward truck and the tail skid plate such that contact with the ground by the audio entertainment device is prevented and possible damage is minimized. The mounting position of the audio entertainment is preferably such that an associated speaker is mounted directly beneath one or more apertures in the skateboard so that the audio output of the speaker is directed upward. An acoustically permeable screen is utilized to protect the speaker and, in a preferred embodiment of the present invention, a guard plate is provided to further protect the audio entertainment device from inadvertent contact with the ground.

14 Claims, 3 Drawing Sheets

Fig.1
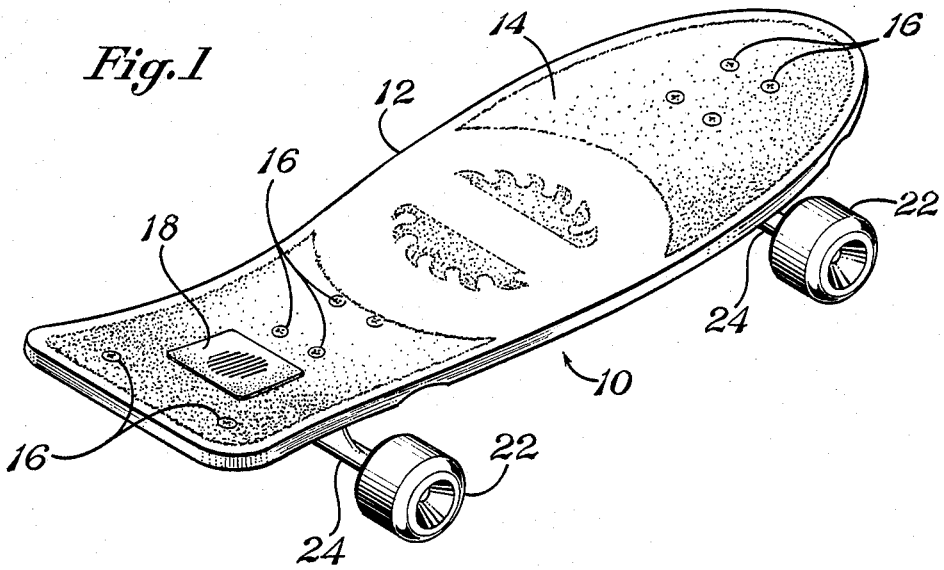
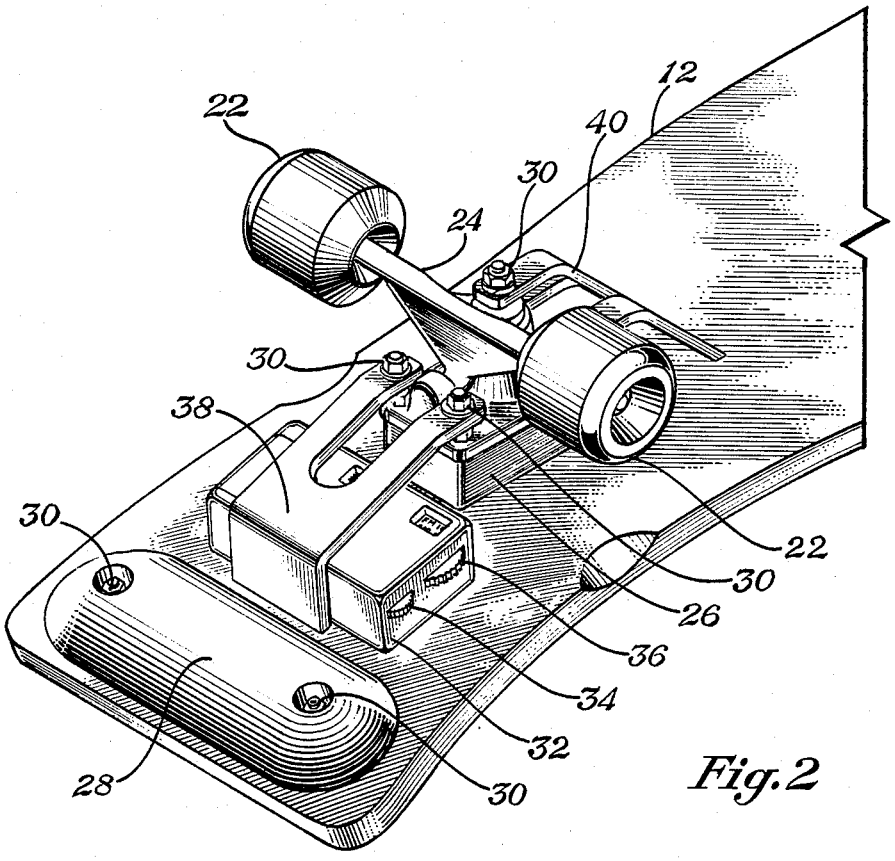
Fig.2

Fig. 7
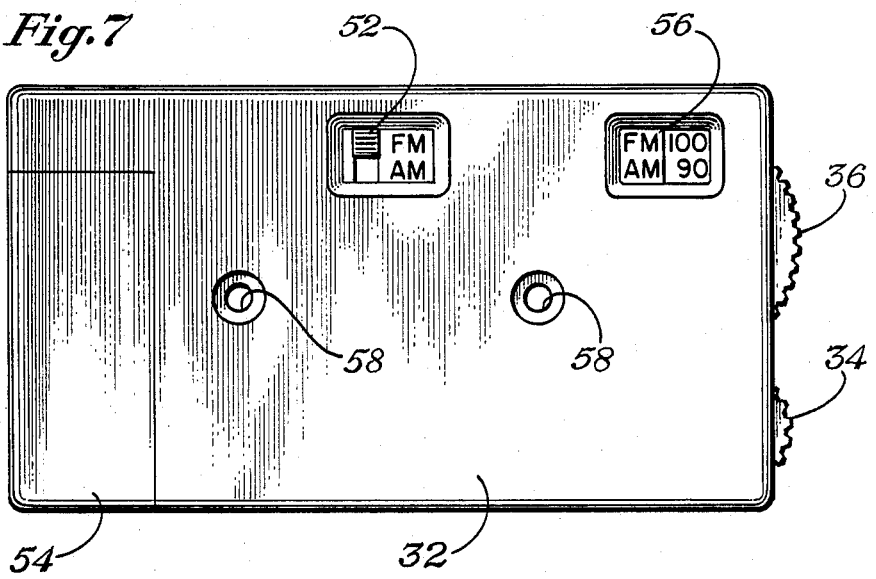
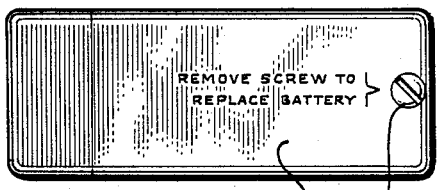
Fig. 8
Fig. 10
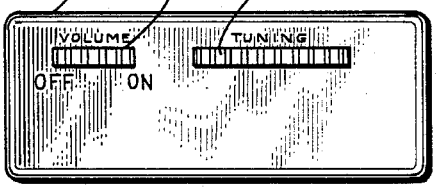
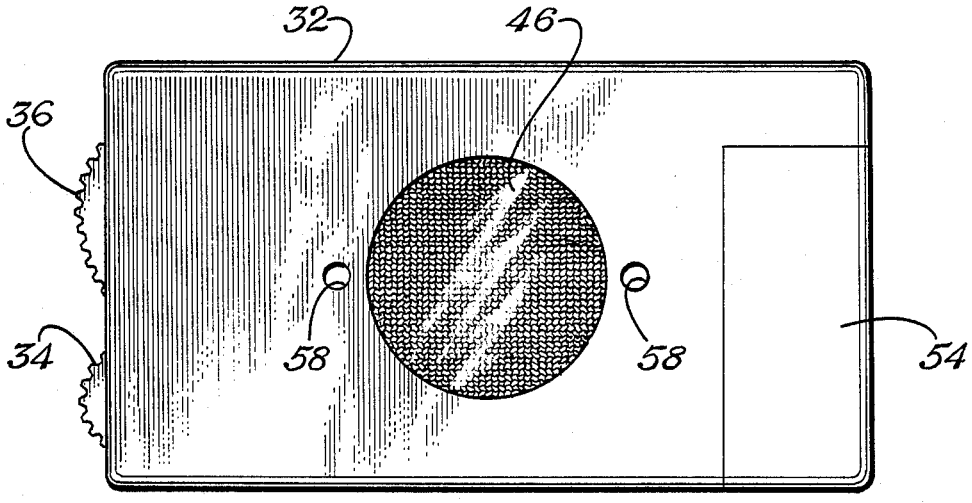
Fig. 9

SKATEBOARD WITH AUDIO ENTERTAINMENT DEVICE

BACKGROUND OF THE INVENTION

1. Field of the Invention

This invention relates in general to recreational vehicles such as skateboards and more particularly to skateboards which incorporate an audio entertainment device, such as a radio receiver.

2. Description of the Prior Art

The increased popularity of surfing in past years has lead to the design of the "sidewalk surfboard" or "skateboard" which permits the rider to simulate the activities of surfing without the requirement for an ocean. From its simple beginning as a board mounted to a plurality of roller skate wheels, the skateboard has advanced in both design and technology. Specialized wheel mounts, or "trucks" which permit turning by shifting of the rider's weight have become commonplace. Various guards and rails have been added to protect the board and permit the rider to perform handstands or other acrobatic tricks.

More recently, a skateboard has been disclosed which utilizes a pair of hand grips to facilitate such acrobatic efforts while simultaneously permitting a rider to positively engage his feet with the board while performing jumps. An example of this design may be seen in U.S. Pat. No. 4,159,121, issued June 26, 1979.

A second aspect of the popularity of the surfing and skateboard culture is the music which is associated therewith. In order to simultaneously enjoy the music and its associated sport, it is currently necessary for a rider to constrain his or her activities to an area near a radio or tape player. This is generally not acceptable when a rider desires to travel from one point to another. An alternative procedure for enjoying music while skateboarding involves the utilization of a small personal stereo; however, the earphones utilized with these devices can prevent a rider from hearing automobile horns, sirens, or other audible warning devices and may result in serious injury to the rider.

Thus, it should be apparent that a need exists for an apparatus which will permit a rider of a skateboard to enjoy music while riding the skateboard.

SUMMARY OF THE INVENTION

It is therefore one object of the present invention to provide an improved skateboard.

It is another object of the present invention to provide an improved skateboard having an associated audio entertainment device.

It is yet another object of the present invention to provide an improved skateboard having an associated audio entertainment device mounted in a manner which will prevent damage to the device during skateboard riding.

The foregoing are achieved as is now described. The skateboard of the present invention includes a forward truck and wheel assembly and a rearward truck and wheel assembly. A tail skid plate is preferably mounted at the rear of the skateboard on the lower surface of the board. An audio entertainment device, such as a radio receiver, is mounted to the lower surface of the skateboard between the rearward truck and wheel assembly and the tail skid plate, such that contact with the ground by the audio entertainment device is prevented and possible damage is minimized. The mounting position of the audio entertainment device is preferably such that an associated speaker is mounted directly beneath one or more apertures in the skateboard so that the audio output of the speaker is directed upward. An acoustically permeable screen is utilized to protect the speaker and, in a preferred embodiment of the present invention, a guard plate is provided to further protect the audio entertainment device from inadvertent contact with the ground.

The above as well as additional objects, features, and advantages of the invention will become apparent in the following detailed description.

BRIEF DESCRIPTION OF THE DRAWING

The novel features believed characteristic of the invention are set forth in the appended claims. The invention itself; however, as well as a preferred mode of use, further objects and advantages thereof, will best be understood by reference to the following detailed description of an illustrative embodiment when read in conjunction with the accompanying drawings, wherein:

FIG. 1 depicts a perspective view of a skateboard constructed in accordance With the present invention;

FIG. 2 is a perspective view of the lower surface of the rear of a skateboard constructed in accordance with the present invention which depicts the mounting of an audio entertainment device;

FIG. 7 is a plan view of the bottom of an audio entertainment device which may be utilized in accordance with the present invention;

FIG. 8 is an end view of a first end of the audio entertainment device of FIG. 7;

FIG. 9 is a plan view of the top of the audio entertainment device of FIG. 7, depicting an associated speaker; and FIG. 10 is an end view of a second end of the audio entertainment device of FIG. 7.

DETAILED DESCRIPTION OF THE INVENTION

Figure 3:
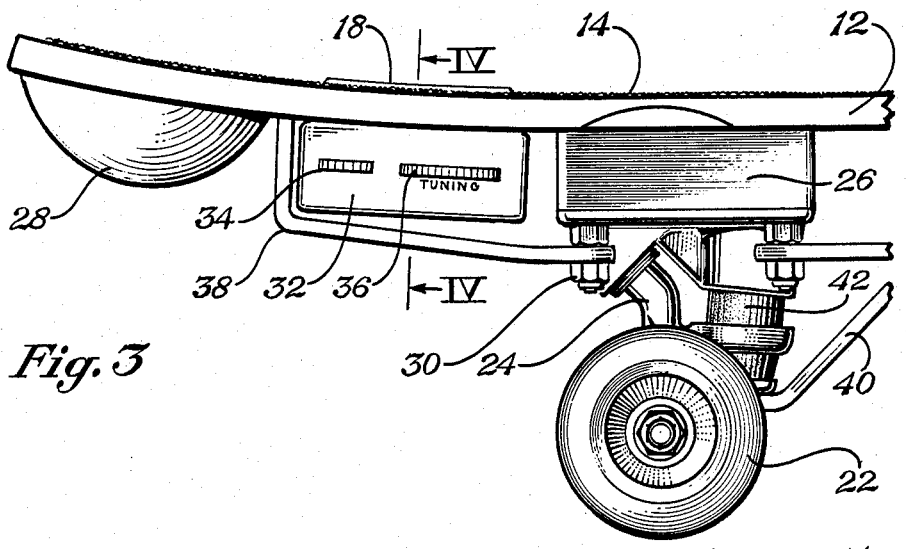
FIG. 3 is a side view of the rear of a skateboard constructed in accordance with the present invention.

With reference now to the figures and in particular with reference to FIG. 1, there is depicted a perspective view of a skateboard 10 which has been constructed in accordance with the present invention. As can be seen, skateboard 10 is constructed utilizing a board 12 which is preferably Constructed of a multi-ply wooden material. In an Alternate embodiment of the present invention, board 12 may be constructed of a plastic material. The upper surface of board 12 includes an abrasive surface 14 which is provided to ensure firm placement and grip of the feet of the operator on the upper surface of board 12.

A plurality of mounting bolts 16 are utilized, in accordance with a technique well known in the art, to mount a pair of wheel mounts or "trucks" 24, each of which has a pair of ground engaging wheels 22. Ground engaging wheels 22 are preferably constructed of a plastic material such as urethane and preferably include mounting bearings (not shown) to facilitate smooth rotation of ground engaging wheels 22. Also depicted in FIG. 1 is speaker grill 18 which is preferably an acoustically permeable plastic grill which may be utilized, in accordance with one aspect of the present invention, to protect the speaker of an associated audio entertainment device from contaminants while simultaneously supporting the weight of an operator of skateboard 10.

Referring now to FIG. 2, there is depicted a perspective view of the lower surface of skateboard 10. As can be seen, rear truck 24 is mounted to the lower surface of board 12 in conjunction with an elastic spacer 26. Elastic spacer 26 is utilized to cushion the ride of skateboard 10 and provide a measure of shock absorption for the operator. As can be seen, rear truck 24 is typically bolted to board 12 utilizing a plurality of mounting bolts 16 and mounting nuts 30.

At the forward end of rear truck 24, truck guard 40 is mounted to protect rear truck 24 from inadvertent contact with curbs or other protuberances which might damage rear truck 24 during operation. Also mounted to the lower surface of board 12 is tail skid 28 which is preferably constructed utilizing a plastic material such as urethane and which is mounted to the rear of the lower surface of board 12 utilizing mounting bolts 16 and mounting nuts 30. The purpose of tail skid 28 is to permit the operator to pivot the skateboard by placing his weight to the rear of rear truck 24 raising the front Of skateboard 10 and engaging the ground with tail skid 28.

Still referring to FIG. 2, it can be seen that an audio entertainment device 32 has been mounted to the lower surface of board 12 between the mounting position of tail skid 28 and rear truck 24. This particular mounting position has been proven by the Applicant to result in a minimal possibility of contact with the ground by audio entertainment device 32 so that damage to audio entertainment device 32 is minimized. In order to further protect audio entertainment device 32, a guard plate 35 is preferably provided. Guard plate 38 is preferably constructed utilizing a metallic material or, in an alternative embodiment, a heavy plastic material. As can be seen, guard plate 38 may be simply mounted in place utilizing one pair of mounting bolts 16 and mounting nuts 30 which are also utilized to secure rear truck 24 to board 12.

While the depicted embodiment of the present invention discloses audio entertainment device 32 as an AM/FM radio including volume on/off control 34 and tuning control 36, those ordinarily skilled in the art will appreciate that any audio entertainment device may be utilized in accordance with the present invention. For example, a cassette tape player or compact disc player may be substituted by slightly varying the design of guard plate 38 to accommodate the insertion of cassette tapes or compact discs.

With reference now to FIG. 3, there is depicted a side view of the rear of skateboard 10 which has been constructed in accordance with the present invention. As can be seen, rear truck 24 has been flexibly mounted to board 12 through elastic spacer 26. The mounting position of audio entertainment device 32 in conjunction with guard plate 35 can be seen to provide a protective mount wherein audio entertainment device 32 will be precluded from contacting the ground or other protuberance which might cause inadvertent damage to audio entertainment device 32.

Figure 4:
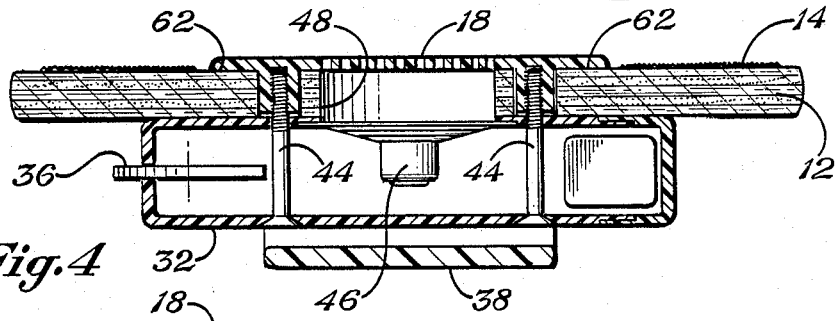
FIG. 4 is a partial sectional view of the audio entertainment device and skateboard constructed in accordance with the present invention taken along line IV—IV of FIG. 3.

Referring now to FIG. 4, there is depicted a partial sectional view of audio entertainment device 32 and skateboard 10 taken along line IV—IV of FIG. 3. As can be seen, audio entertainment device 32 is mounted in conjunction with an aperture 48 which communicates from the lower surface of board 12 to the upper surface of board 12. Speaker grill 18 is utilized in conjunction with radio receiver mounting bolts 44 to firmly and safely attach audio entertainment device 32 to the lower surface of board 12 by compressing board 12 between the case of audio entertainment device 32 and speaker grill flange 62. In this manner, an associated speaker 46 is firmly and fixedly mounted in juxtaposition with aperture 48 so that the audio output from audio entertainment device 32 is directed upward through aperture 48 and speaker grill 18.

Figure 5:
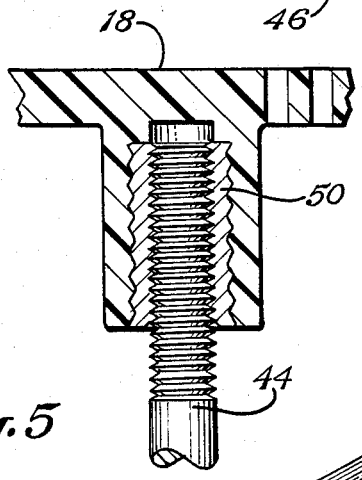
FIG. 5 is an enlarged view of one embodiment of one of the mounting bolts utilized to mount an audio entertainment device to the skateboard in accordance with the present invention.

With reference now to FIG. 5, there is depicted an enlarged view of an alternate embodiment of a mounting technique which may be utilized to mount audio entertainment device 32 to board 12. In those applications in which it is desired to construct speaker grill of a plastic material, it may be advisable to press a metal insert 50 into the plastic body of speaker grill 18 in order to provide a receptive aperture for radio receiver mounting bolts 44. Those skilled in the art will appreciate that While the utilization of a metal insert 50 is preferable, it is not necessary.

Figure 6:
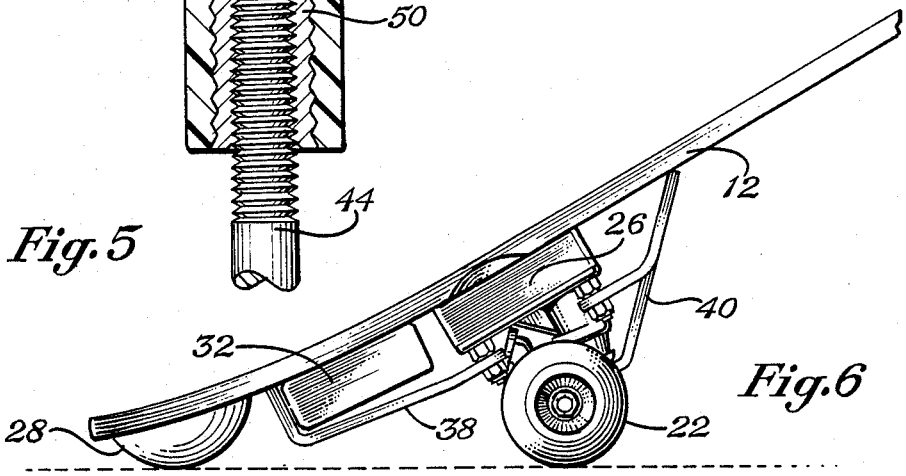
FIG. 6 is a side view of the rear of a skateboard constructed in accordance with the present invention demonstrating the operation of the tail skid member.

Referring now to FIG. 6, there is depicted a side view of the rear of skateboard 10 which demonstrates the operation of tail skid 28. As can be seen, when the operator Of skateboard 10 moves his weight to the rear of rear truck 24, the rear end of board 12 will be forced downward, causing tail skid 28 to come into contact with the ground. As depicted in FIG. 6, when board 12 is rotated into the position shown, board 12 in contacts the ground at tail skid 28 and rear wheels 22. In its depicted mounting position, audio entertainment device 32 is safely constrained to an area wherein contact with the ground is not possible. To further ensure that damage to audio entertainment device 32 does not occur, guard plate 38 is depicted in a position which surrounds audio entertainment device 32 and which will prevent damage to audio entertainment device 32 should the operator move his weight rearward while audio entertainment device 32 is disposed over an uneven surface.

With reference now to FIGS. 7 and 10, there is depicted a plan view of the bottom of audio entertainment device 32 which may be utilized in conjunction with skateboard 10 in accordance with the present invention. As can be seen, audio entertainment device 32, in the depicted embodiment of the present invention, is an AM/FM radio receiver. Volume on/off control 34 and tuning control 36 are utilized, in a manner well known in the art, to control the operation of audio entertainment device 32. AM/FM switch 52 may be utilized to manually switch the operation of audio entertainment device 32 from the AM mode of operation to the FM mode of operation and tuning indicator 56 can be utilized to present a visual indication of the tuning status of audio entertainment device 32. Also depicted in FIG. 7 is battery chamber 54 and mounting apertures 58 which may be utilized to receive radio receiver mounting bolts 44 in the manner depicted in FIG. 4. In the preferred embodiment of the present invention, audio entertainment device 32 is preferably constructed utilizing any high impact plastic material.

Referring now to FIG. 8, there is depicted an end view of one end of audio entertainment device 32 of FIG. 7. As can be seen, in the depicted embodiment of the present invention, an ordinary screw 60 may be utilized to secure the aperture to battery compartment $4. In this manner, the operator of skateboard 10 may utilize audio entertainment device 32 without the requirement for an electrical power source by merely changing batteries as required.

Referring now to FIG. 9, there is depicted a plan view of the top of audio entertainment device 32 which depicts its associated speaker 46. As can be seen, mounting apertures 55 surround speaker 46 and may be utilized, in accordance with the present invention, to mount audio entertainment device 32 such that speaker 46 is in direct juxtaposition with aperture 48 (see FIG. 4). In this manner, an operator of skateboard 10 may freely ride the skateboard in any area and any direction while simultaneously providing a source of music which does not handicap his ability to detect automobile horns, sirens, or other audible warning devices.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

What is claimed is:

1. An improved skateboard comprising:

(a) a board having a lower surface and an upper surface adapted to support a rider;

(b) a plurality of ground engaging members mounted to said lower surface including at least a forward truck and wheel assembly, a rearward truck and wheel assembly, and a tail skid member mounted at the rear of the board on said lower surface;

(c) an audio entertainment device secured to the board on said lower surface between said rearward truck and wheel assembly and said tail skid member; and (d) audio output means associated with said audio entertainment device.

2. The improved skateboard according to claim 1 wherein said board is constructed of a multi-ply wooden material.

3. The improved skateboard according to claim 1 wherein each of said truck and wheel assemblies includes an elastic spacer pad mounted between said truck and wheel assembly and said board.

4. The improved skateboard according to claim 1 wherein said audio entertainment device comprises a radio receiver.

5. The improved skateboard according to claim 1 wherein said audio output means comprises a speaker and associated speaker grill.

6. The improved skateboard according to claim 1 wherein the upper surface of said board includes an abrasive material wherein the operator can ensure firm placement of his feet on the upper surface of said board.

7. An improved skateboard comprising:

(a) a board having a lower surface and an upper surface adapted to support a rider;

(b a plurality of ground engaging members mounted to said lower surface including at least a forward truck and wheel assembly, a rearward truck and wheel assembly and a tail skid member mounted at the rear of the board on said lower surface;

(c) a radio receiver secured to the board on said lower surface between said rearward truck and wheel assembly and said tail skid member;

(d) a plurality of manually operable controls for controlling the operation of said radio receiver;

(e) audio output means associated with said radio receiver and mounted to said lower surface in conjunction with at least one aperture communicating between said lower surface and said upper surface of said board; and (f) an acoustically permeable screen mounted substantially coplanar with said upper surface above said at least one aperture wherein said audio output means is protected from contaminants.

8. The improved skateboard according to claim 7 wherein said board is constructed of a multi-ply wooden material.

9. The improved skateboard according to claim 7 wherein each of said truck and wheel assembles includes an elastic spacer pad mounted between said truck and wheel assembly and said board.

10. The improved skateboard according to claim 7 wherein said radio receiver comprises a battery powered AM/FM radio receiver.

11. The improved skateboard according to claim 7 wherein said plurality of manually operable controls includes a volume control and a tuning control.

12. The improved skateboard according to claim 7 wherein said audio output means comprises a speaker and associated speaker grill.

13. The improved skateboard according to claim 7 wherein said acoustically permeable screen comprises a plastic screen.

14. The improved skateboard according to claim 7 wherein the upper surface of said board includes an abrasive material wherein the operator can ensure firm placement of his feet on the upper surface of said board.

* * * * *

UNITED STATES PATENT AND TRADEMARK OFFICE

CERTIFICATE OF CORRECTION

PATENT NO. : 4,824,139

DATED : April 25, 1989

INVENTOR(S) : William D. Robbins

It is certified that error appears in the above-identified patent and that said Letters Patent is hereby corrected as shown below:

Title page, item [73] delete "n" and add --N--.

Signed and Sealed this

Seventeenth Day of October, 1989

*Attest:*

DONALD J. QUIGG

*Attesting Officer*

*Commissioner of Patents and Trademarks*